United States Patent [19]

Wilde

[11] Patent Number: 4,813,186

[45] Date of Patent: Mar. 21, 1989

[54] APPARATUS FOR CONVERTING A COMPRESSED AIR OPERATING PULSE TO A HYDRAULIC OPERATING PULSE FOR A GRINDING MACHINE ESPECIALLY FOR A PRECISION GRIDING MACHINE

[75] Inventor: Rolf Wilde, Wuppertal, Fed. Rep. of Germany

[73] Assignee: Maschinenfabrik Ernst Thielenhaus GmbH, Wuppertal, Fed. Rep. of Germany

[21] Appl. No.: 103,532

[22] Filed: Sep. 30, 1987

[30] Foreign Application Priority Data

Oct. 2, 1986 [DE] Fed. Rep. of Germany ..... 3633530

[51] Int. Cl.[4] ..... B24B 49/08

[52] U.S. Cl. ..... 51/165.9; 51/33 W; 51/291

[58] Field of Search ..... 51/33 W, 165.9, 58, 51/60, 68, 291

[56] References Cited

FOREIGN PATENT DOCUMENTS 0465864 9/1981 U.S.S.R. ..... 51/165.9

0950970 8/1982 U.S.S.R. ..... 51/165.9

*Primary Examiner*—Frederick R. Schmidt

*Assistant Examiner*—Robert A. Rose

*Attorney, Agent, or Firm*—Herbert Dubno

[57] ABSTRACT

An apparatus is provided for converting a pressurized air operating impulse to a hydraulic operating impulse, especially for a precision grinding machine. The apparatus comprises at least one tool support, a compressed air control system for a plurality of adjusting or positioning piston cylinder devices, and a cooling and washing fluid system. The tool support has a fed piston cylinder device which is provided with two pressurized medium inlets, one of these inlets being for the feeding and pressing on motion, the other one being for the take off motion. Two regulating chambers mounted vertically are provided with connecting members for the pressurized medium inlets of the fed piston cylinder device in the lower portion of the regulating chambers. Further, a flow control device for feeding of wash and cooling fluid into the regulating chamber with a level control device and an controlling air connector are present in each of the regulating chambers above the level of the wash and cooling fluid in the regulating chamber which is controlled by the level control device. The controlling and operating impulse of the pressurized air control system acts on the level of the controlling wash and cooling fluid in the regulating chamber.

4 Claims, 2 Drawing Sheets

APPARATUS FOR CONVERTING A COMPRESSED AIR OPERATING PULSE TO A HYDRAULIC OPERATING PULSE FOR A GRINDING MACHINE ESPECIALLY FOR A PRECISION GRIDING MACHINE

FIELD OF THE INVENTION

My present invention relates to an apparatus for converting a compressed air operating pulse to a hydraulic operating pulse and to the operating mechanism of a grinding machine, especially a precision grinding machine.

BACKGROUND OF THE INVENTION

A grinding machine can receive a pressurized air operating pulse for feeding the grinding wheel against a workpiece. The apparatus can comprise at least one tool support, a pressurized air control system for a plurality of adjustable piston-and-cylinder devices and a cooling and flushing liquid system whereby a liquid is trained on the grinding location.

The tool support has a positioning feed piston-and-cylinder device which is provided with two pressurized medium inlets, one of the inlets being for the feeding and pressing motion and the other being for the tool-retraction motion.

In a grinding machine, especially a precision grinding machine having the described basic structure (see German Pat. No. 7 52 064 and German Pat. No. 17 52 520), the tool support is integrated with its adjustable piston cylinder device in the pressurized air control system. Since positioning is effected by compressed air which is a compressible medium, inaccuracies can result during precision grinding. Independently of the pressurized air control system, a wash and cooling fluid system is usually provided which feeds wash and cooling fluid with a redetermined pressure to the operating location.

OBJECTS OF THE INVENTION

It is an object of my invention to provide an improved apparatus for converting a pressurized operating pulse int a hydraulic operating pulse in a grinding machine, particularly a precision grinding machine, whereby the above-mentioned drawbacks can be avoided.

It is another object of my invention to provide an improved apparatus for converting a pressurized operating pulse into a hydraulic operating pulse in a grinding machine, particularly a precision grinding machine, which is both simple and reliable.

It is a further object of my invention to provide a simpler more reliable apparatus for converting a pressurized operating pulse into a hydraulic operating pulse in a grinding machine, particularly a precision grinding machine, in which the adjusting or positioning piston-and-cylinder devices can be selectively repositioned independent of or converted to hydraulic operation.

SUMMARY OF THE INVENTION

These objects and others which will become more readily apparent hereinafter are attained in accordance with my invention. The invention provides an apparatus for converting a pressurized air operating pulse to a hydraulic operating pulse, particularly in a precision grinding machine, comprising at least one tool support, a pressurized air control system for a plurality of adjustable piston-and-cylinder devices, and a cooling and flushing liquid system.

The tool support has a feed piston-and-cylinder device which is provided with two pressurized medium inlets, one of the pressurized medium inlets being for the feeding and pressing movement and the other of the inlets being for the retraction movement.

According to my invention this apparatus further comprises two vertically mounted regulating chambers with a plurality of connecting members for the pressurized medium inlets of the feed piston-and-cylinder device in the bottom portion of the regulating chambers and a flow control device for feeding flushing and cooling fluid into the regulating chambers. A level control device is associated with the regulating chambers. A controlling air connector in each of the regulating chambers above the level of the flushing and cooling fluid is controlled by the level control device.

The operating pulse of the pressurized air control system acts on the surface of the level-controlled flushing and cooling fluid in the regulating chamber.

Generally the regulating chambers are mounted in a common housing.

According to the pressure with which the flushing and cooling fluid system operates, the flow control device for feeding the flushing and cooling fluid can have a pressure limiting overflow valve, e.g. with spring-loading or weight-loading. The structure of the level controlling device is basically up to the designer.

According to one embodiment of my invention the level control device comprises a float controller with a float mounted in the regulating chamber and a float controlled valve located in the head of the regulating chamber for the flushing and cooling fluid.

According to another embodiment the level control device has a level sensor located in the regulating chamber and an electronically operated valve operated by the level sensor by level control electronics for feeding the flushing and cooling fluid in operation.

The apparatus according to my invention permits hydraulic activation of the positioning or adjusting piston-and-cylinder devices of the tool support without requiring a special and separate hydraulic control system to be installed.

The grinding machine and especially a precision grinding machine having the above described basic structure can be shifted or changed by the apparatus according to my invention for hydraulic activation of the feed piston-and-cylinder device of the tool support.

The structure of the apparatus can be such that according to choice a hydraulic activation or a compressed air activation of the feed piston-and-cylinder device of the tool support occurs and of course by a shift or change over in which, when compressed air is used to activate the feed piston-and-cylinder device, the apparatus according to my invention is put into external drive.

The pressurized air control system operates with a structure for the apparatus according to my invention which is usually not otherwise changed and fulfills the numerous functions for the pressurized air activated positioning piston-and-cylinder device in an unchanged way. In regard to the positioning of the tool, however, a transformation of the medium occurs.

Thus the flushing and cooling fluid can be used directly as the hydraulic medium for the hydraulic control.

When during use of the apparatus according to my invention the feed piston-and-cylinder device of the tool support is acted on by a hydraulic medium, the previously described problems are eliminated. Of course, during use of the apparatus according to my invention the hydraulic medium is acted on and controlled by the operating pulse of the compressed air control systems, since the feed piston-and-cylinder device is connected by an appropriate pressurized medium duct whose diameter can be kept small. The compressibility of the pressurized medium because of the flushing and cooling fluid in the regulating chamber no longer acts disadvantageously.

BRIEF DESCRIPTION OF THE DRAWING

The above and other objects, features and advantages of my invention will become more readily apparent from the following description, reference being made to the accompanying highly diagrammatic drawing in which.

SPECIFIC DESCRIPTION

Figures 1, 1A:
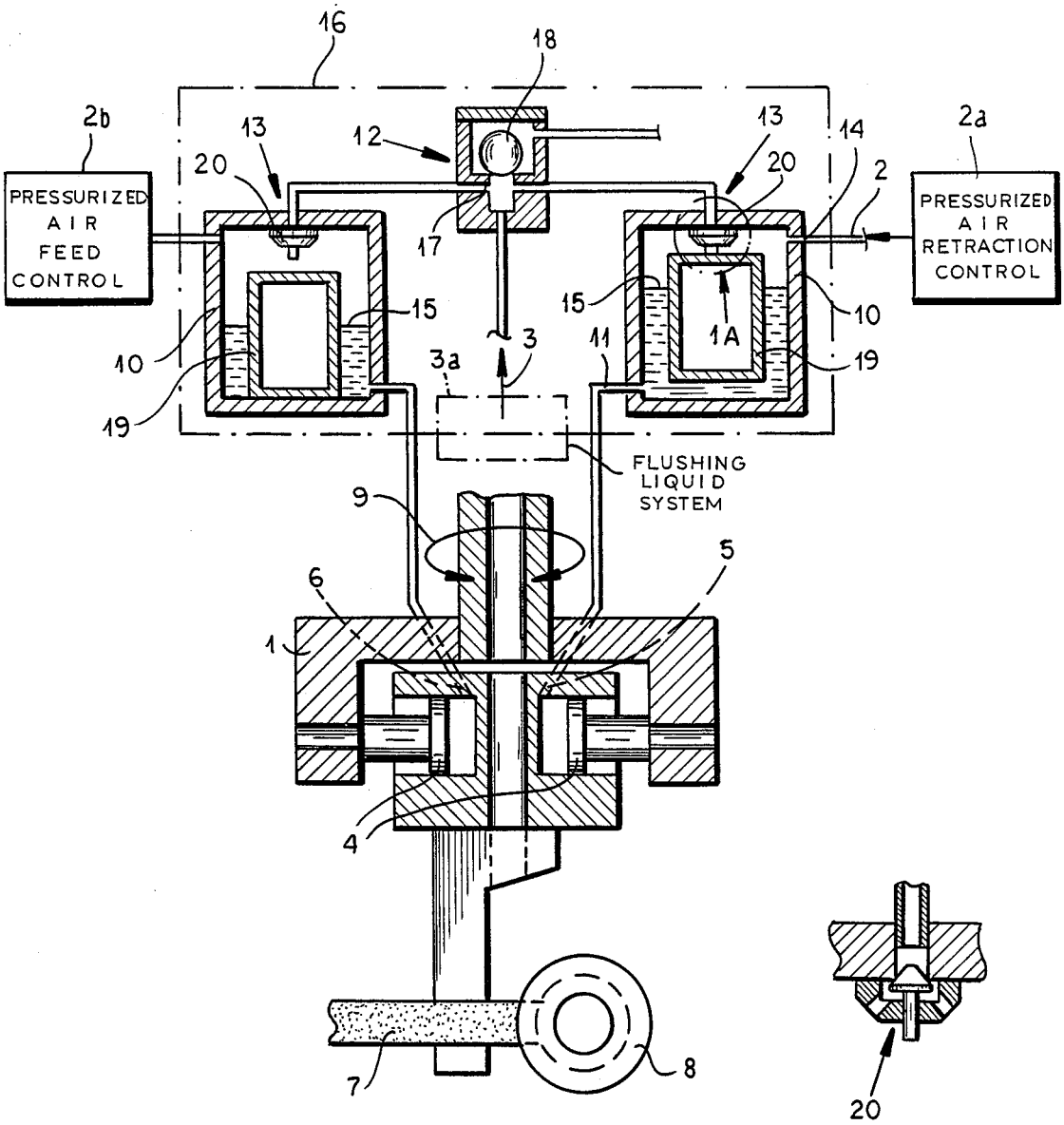
FIG. 1 is a schematic diagram of an apparatus for converting a compressed air operating pulse to a hydraulic operating pulse according to my invention.
FIG. 1A is a detail of the region IA of FIG. 1.

The apparatus shown in the drawing can convert a compressed air operating pulse into a hydraulic operating pulse in a grinding machine, particularly a precision grinding machine.

Thus a grinding machine has at least one tool support 1, a compressed air control system 2 for a plurality of adjusting piston-and-cylinder devices 4 (only one of which is shown) and a flushing and cooling liquid system for feeding a flushing and cooling liquid to the operating location. The flow of the latter is indicated by an arrow 3 in the drawing. However the compressed air control system 2 with the associated units **2*a*, 2*b*** for retraction of feed control and the flushing and cooling liquid system are not really shown in the drawing. Of course the flushing and cooling liquid system could be replaced by another hydraulic system in the system of the invention as the source of liquid.

The tool support 1 has a positioning feed piston-and-cylinder device 4 which is provided with two pressurized medium inlets 5,6, namely one inlet 5 for the retraction movement and another inlet 6 for the feed and pressing movement. The tool support 1 is equipped with a tool 7 and operates on a workpiece 8 indicated on the right which may be a ball bearing ring for example. The ball bearing ring rotates. The tool 7 performs an oscillating pivotal movement which is indicated by the bent double arrow 9 above the positioning piston-and-cylinder device 4.

Two regulating chambers 10 are mounted vertically with connecting members 11 for the pressurized medium inlets 5, 6 of the positioning piston-and-cylinder device 4 at the bottom portion of the regulating chambers 10.

A flow control device 12 for feeding the flushing and cooling liquid into the regulating chambers 10 is provided with a level control device 13 and a controlling air connector 14 connected to the top portion or head of each of the regulating chambers 10 above the level 15 of the flushing and cooling liquid controlled by the level control device 13.

During operation of the positioning feed piston-and-cylinder devices 4, the flushing and cooling liquid acts as a pressurized medium and is conducted away as usual. Subsequently, the regulating chambers 10 are feed in the described way.

The operating pulse of the pressurized air control system 2 acts on the surface 15 of the level-controlled flushing and cooling liquid in the regulating chambers 10. The regulating chambers 10 are mounted in a common housing 16. The flow control device 12 for the liquid level in this example has a pressure limiting overflow valve 17 whose controlling ball 18 is weight-loaded.

The level control device 13 is a float control with a float 19 positioned in the regulating chamber 10 (in this case this device is in both of the chambers) and a float controlled valve 20 for feeding the flushing and cooling liquid under control of the float in the regulating chamber 10. The float controlled valves 20 are, for example, non-return valves.

By head of the regulating chamber 10 mentioned in the following claims, I mean the top of the regulating chamber 10.

Figure 2:
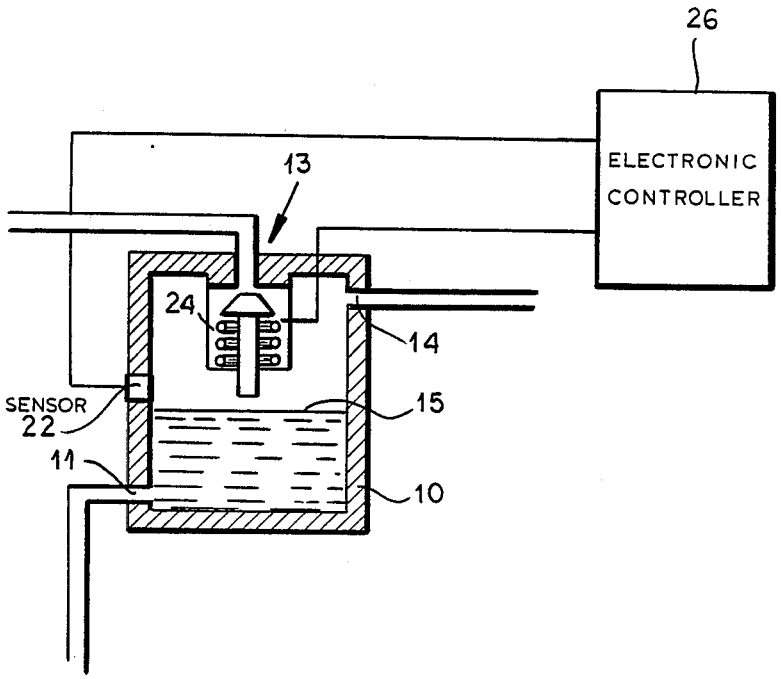
FIG. 2 is a part of a schematic diagram of another example of the apparatus according to my invention having an alternative structure for the level control device.

An alternative example of structure according to my invention used for controlling the flushing and cooling liquid level in the regulating chambers 10 is shown in FIG. 2. The level control device 13 here includes a level sensor 22 mounted in the regulator chamber 10 and an electronically operated valve 24 operated by the level sensor 22 by level control electronics 26 connected to the level sensor for feeding the flushing and cooling liquid. Otherwise this embodiment operates in the same manner as the embodiment originally described.

I claim:

1. In an apparatus for converting a pressurized air operating pulse to a hydraulic operating pulse, for a grinding machine, comprising at least one tool support, a pressurized air control system for a plurality of adjustable piston-and-cylinder devices and a cooling and flushing liquid system, said tool support having a feed piston-and-cylinder device which is provided with two pressurized medium inlets, one of said pressurized medium inlets being for the feeding and pressing movement and the other of said inlets being for the retraction movement, the improvement comprising two vertically mounted regulating chambers with a plurality of connecting members for said pressurized medium inlets of said feed piston-and-cylinder device in the bottom portion of said regulating chambers, a flow control device for feeding said flushing and cooling liquid into said regulating chambers with a level control device and a controlling air connector in each of said regulating chambers above the level of said flushing and cooling liquid which is controlled by said level control device, said operating pulse of said pressurized air control system acting on said level of said flushing and cooling liquid in at least one of said regulating chambers, said flow control device having a pressure limiting overflow valve for said flushing and cooling liquid, said level control device being a float control including a float mounted in said regulating chamber and a float controlled valve mounted in a head of said regulating chamber for said flushing and cooling liquid.

2. The improvement according to claim 1 wherein said regulating chambers are mounted in a common housing.

3. The improvement according to claim 1 wherein said level control device includes a level sensor mounted in said regulator chamber and an electronically operated valve operated by said level sensor by level control electronics for said flushing and cooling liquid.

4. An apparatus for converting a pressurized air operating pulse to a hydraulic operating pulse, particularly in a precision grinding machine, comprising:

at least one tool support including a feed piston-and-cylinder device provided with two pressurized medium inlets, one of said pressurized medium inlets being for the feeding and pressing movement and the other of said inlets being for the retraction movement;

two vertically mounted regulating chambers mounted in a common housing and having a plurality of connecting members for said pressurized medium inlets of said feed piston-and-cylinder device in a bottom portion of said regulating chambers;

a flow control device for feeding said flushing and cooling liquid into said regulating chambers with a pressure limiting overflow valve for said flushing and cooling liquid and a level control device which is a float control including a float mounted in said regulating chamber and a float controlled valve mounted in the head of said regulating chamber for said flushing and cooling liquid; and a controlling air connector in each of said regulating chambers above the level of said flushing and cooling liquid which is controlled by said level control device in each of said regulating chambers, said operating pulse of said pressurized air control system acting on said level of said flushing and cooling liquid in at least one of said regulating chambers.

* * * * *